US010499166B2

(12) United States Patent
Margot et al.

(10) Patent No.: US 10,499,166 B2
(45) **Date of Patent: *Dec. 3, 2019**

(54) HEARING AID COMPRISING A RECEIVER ASSEMBLY

(71) Applicants: OTICON A/S, Smørum (DK); BERNAFON AG, Berne (CH)

(72) Inventors: Roland Margot, Berne (CH); Ben Crook, Berne (CH); Lars Persson, Smørum (DK); Henning Bjerregaard, Smørum (DK); Sune Heibing, Smørum (DK); Niels Erik Holm Christensen, Virum (DK); Mikael Andersen, Smørum (DK); Claus Tipsmark, Smørum (DK); Martin Larsen, Smørum (DK); Peter Spragge, Smørum (DK); Lars Monroy, Kongens Lyngby (DK); Poul Hilding Andersson, Smørum (DK)

(73) Assignees: OTICON A/S, Smørum (DK); BERNAFON AG, Berne (CH)

( * ) Notice: Subject to any disclaimer, the term of this patent is extended or adjusted under 35 U.S.C. 154(b) by 0 days.

This patent is subject to a terminal disclaimer.

(21) Appl. No.: 16/033,801

(22) Filed: Jul. 12, 2018

(65) Prior Publication Data

US 2018/0324531 A1 Nov. 8, 2018

Related U.S. Application Data

(62) Division of application No. 15/263,801, filed on Sep. 13, 2016, now Pat. No. 10,051,383.

(30) Foreign Application Priority Data

Sep. 30, 2015 (EP) ..... 15187776

(51) Int. Cl.
*H04R 25/00* (2006.01)
*H04R 1/28* (2006.01)

(52) U.S. Cl.
CPC ..... *H04R 25/456* (2013.01); *H04R 25/604* (2013.01); *H04R 1/2876* (2013.01); *H04R 2460/17* (2013.01)

(58) Field of Classification Search
CPC .. H04R 25/456; H04R 25/604; H04R 1/2876; H04R 2460/17
See application file for complete search history.

(56) References Cited

U.S. PATENT DOCUMENTS 3,048,668 A 8/1962 Weiss
4,440,982 A * 4/1984 Kaanders ..... H04R 25/604 381/312

(Continued)

FOREIGN PATENT DOCUMENTS

EP 2 753 102 A1 7/2014
WO WO 2007/038897 A2 4/2007
WO WO 2007/038897 A3 4/2007

*Primary Examiner* — Tuan D Nguyen
(74) *Attorney, Agent, or Firm* — Birch, Stewart, Kolasch & Birch, LLP

(57) ABSTRACT

A hearing aid comprising a receiver assembly is disclosed. The receiver assembly includes a housing adapted to accommodate receivers of different geometry and/or size and/or mechanical dimensions and suspension member arranged in the housing. The suspension member comprises vibration dampers protruding from an outer periphery of the suspension member and a plurality of spacers provided at an inner periphery of the suspension member. The plurality of spacers is positioned to arrange and fix one or more cushions or enclosed structures in predefined grooves formed by adjacent spacers in the space between the receiver and the suspension member.

10 Claims, 7 Drawing Sheets

(56) References Cited

U.S. PATENT DOCUMENTS

| | | | | |
|---|---|---|---|---|
| 4,854,415 | A | 8/1989 | Goschke | |
| 7,088,839 | B2 * | 8/2006 | Geschiere | H04R 25/604 381/324 |
| 2002/0146141 | A1 * | 10/2002 | Geschiere | H04R 25/604 381/368 |
| 2006/0171549 | A1 | 8/2006 | Holmes | |
| 2007/0036378 | A1 * | 2/2007 | Saltykov | H04R 25/604 381/324 |
| 2007/0053540 | A1 | 3/2007 | Harvey | |
| 2008/0112584 | A1 * | 5/2008 | Karamuk | H04R 25/604 381/324 |
| 2010/0098286 | A1 * | 4/2010 | Giese | H04R 25/456 381/380 |
| 2013/0129127 | A1 | 5/2013 | Wagner et al. | |
| 2013/0279728 | A1 * | 10/2013 | Chan | H04R 25/608 381/324 |
| 2015/0110328 | A1 | 4/2015 | Sondergaard | |
| 2015/0201293 | A1 | 7/2015 | Sanecki et al. | |

* cited by examiner

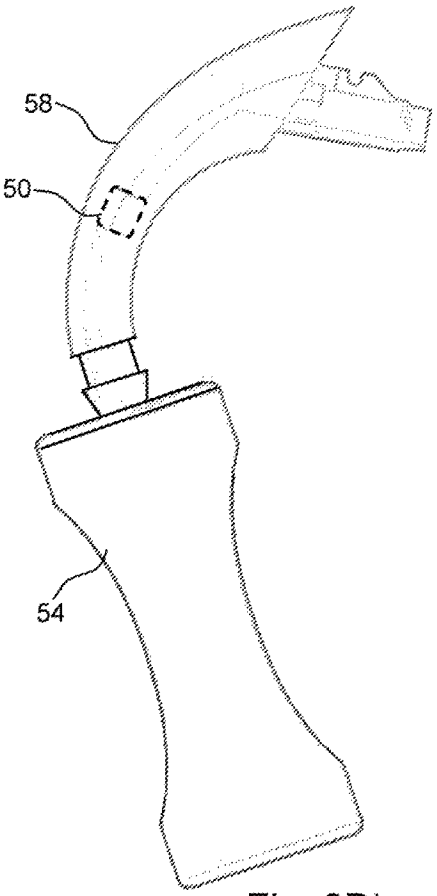
Fig. 6D)
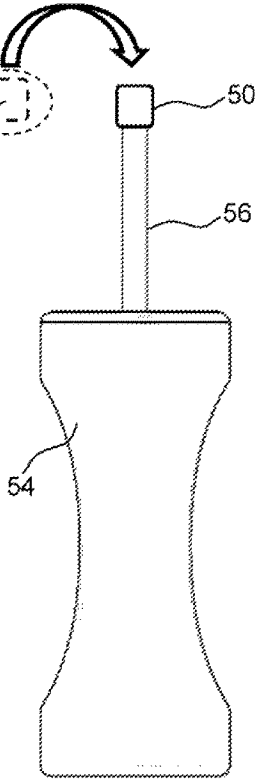
Fig. 6C)
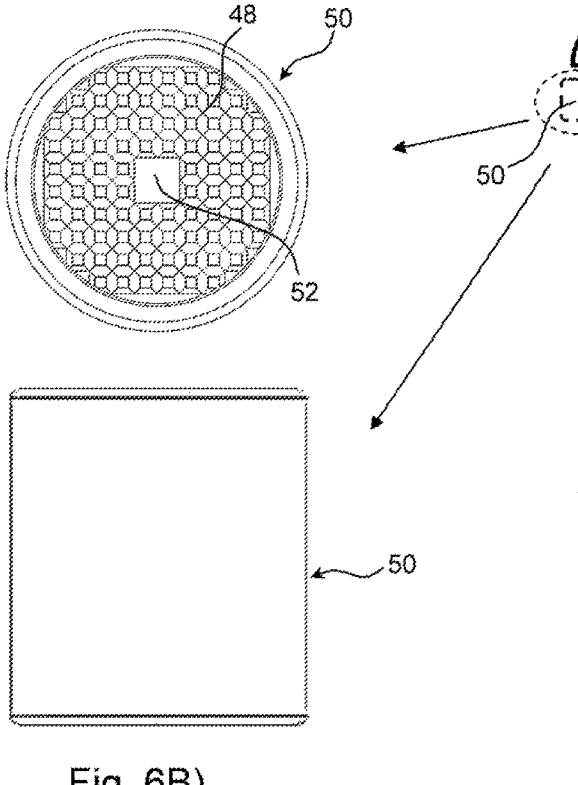
Fig. 6A)
Fig. 6B)

10
64
62

10
68
64
62
66
68'
64'
62

10
64
62
66
70
70

10
60
62
66

10
64
62
68
68'
66
64'
62'

HEARING AID COMPRISING A RECEIVER ASSEMBLY

CROSS REFERENCE TO RELATED APPLICATIONS

This application is a Divisional of copending application Ser. No. 15/263,801 filed on Sep. 13, 2016, which claims priority under 35 U.S.C. § 119(a) to Application No. 15187776.8, filed in Europe on Sep. 30, 2015, all of which are hereby expressly incorporated by reference into the present application.

FIELD

The present disclosure relates to a hearing aid. More particularly, the disclosure relates to a receiver assembly comprised in such hearing aid. The disclosure relates to shock and vibration-damping hearing aid receiver assemblies and to hearing aids in which such receiver assembly is used.

BACKGROUND

Vibration from a hearing aid receiver may get transmitted to one or more microphones via shells, faceplates and other parts comprised in a hearing instrument. Such vibration can cause feedback. To eliminate or reduce such feedback, hearing aid manufacturers may sometimes insert the receiver in an elastomeric casing and/or wrap the receiver in tape before mounting it in the hearing aid. Such casing or the tape reduces the mechanical coupling between the receiver and the shell and thereby reduces the likelihood of feedback from occurring. In addition, the receivers provided in a hearing aid are also sensitive to shock.

In a hearing instrument, it is desirable to reduce mechanical feedback. Accordingly, there is a need to provide a hearing aid that is less sensitive to vibrations that get transferred from receiver assembly to microphones. Also, it is desirable to have a hearing aid where sensitivity of the receiver to shock is reduced.

The present disclosure provides at least an alternative to the conventionally known prior arts.

The present disclosure provides an alternative, in which the hearing aid comprises a receiver assembly that protects the hearing aid receiver against shock and reduces vibration transfer between the receiver and other parts of the hearing aid.

SUMMARY

According to an aspect of the disclosure, the hearing aid comprises a receiver assembly. The receiver assembly comprises a receiver, a suspension member and a housing. The receiver and the suspension member are arranged in the housing. The suspension member comprises vibration dampers protruding from an outer periphery of the suspension member, and one or more cushions or one or more enclosed structures containing a material are provided between the receiver and the suspension member.

The housing may be made of plastic or metal part encasing the receiver, suspension member and one or more cushions or one or more enclosed structures.

The vibration dampers are adapted to limit the amount of vibration transferred from the receiver to other components of hearing aid. In other words, damping of transfer of vibrations from the receiver to the housing reduces transfer of vibrations to other components of the hearing aid such as to the microphone, thus reducing feedback. The one or more air cushions or one or more enclosed structures containing a material are adapted to absorb shock, thus protecting the receiver against impact.

The hearing aid according to an embodiment comprises a receiver assembly that avoids or reduces the transfer of vibrations from the receiver to other hearing aid components such as microphones. Thus, it is possible to provide a hearing aid where components such as microphones are less sensitive to vibrations from the receiver assembly.

The hearing aid comprises the receiver assembly provided with a receiver and a suspension member arranged in the housing. The receiver assembly and its housing may have any suitable size and geometric shape.

The suspension member comprises vibration dampers protruding from an outer periphery of the suspension member. The vibration dampers may have any suitable size and shape. The vibration dampers are adapted to avoid or restrict transmission of receiver vibrations to other parts of the hearing aid. The vibration dampers may further be adapted to center the receiver in the inner housing, which defines the suspension.

One or more cushions or one or more enclosed structures containing a material configured to facilitate shock resistance are provided between the receiver and the suspension member.

In this context, shock is defined as a sudden acceleration caused, for example, by collision with an object having another velocity, impact such as by a tap on the head or shaking of head with hearing aid in use, drop. Likewise, vibration is defined as a (linear or nonlinear) oscillating motion of elastic bodies and the force associated with them.

In this context, vibration is explained in relation to an illustrative example of a receiver. The receiver is capable of converting electric energy to acoustic energy and vice versa. The receiver typically converts electric energy to acoustic energy through a motor assembly having a movable armature. Typically, the armature has one end that is free to move while the other end is fixed to a housing of the receiver. The assembly also includes a drive coil and one or more magnets, both capable of magnetically interacting with the armature. The armature is typically connected to a diaphragm near its movable end. When the drive coil is excited by an electrical signal, it magnetizes the armature. Interaction of the magnetized armature and the magnetic fields of the magnets causes the movable end of the armature to vibrate. Movement of the diaphragm connected to the armature produces sound for output to the human ear. Vibration of the armature and the receiver housing may cause acoustical noise in other components of the electronic device, such as a microphone. Such acoustical noise may cause distortion and feedback within the microphone, thereby reducing the quality of the device. Thus, the disclosure provides a solution to isolate other components of the electronic device from the vibrations created by the receiver.

According to another aspect of the disclosure, the one or more cushions are air cushions. Application of air-filled one or more cushions is associated with several advantages: Air as a filler material is cheap and harmless. Furthermore, one or more cushions may be provided in several configurations in order to meet different requirements with respect to damping properties, and/or geometry. Air may be substituted by one or more gases such as oxygen, carbon dioxide, nitrogen or other suitable gases.

It is possible to apply one or more cushions or one or more enclosed structures containing other filler materials configured to facilitate protection against shock. Such materials may include liquids e.g. water or a thick viscous fluid (paste), powder or gel such as silicone gel.

In the case of application of one or more air cushions, the air pressure inside the air cushions may preferably be the same as the atmospheric pressure. The protection against shock, achieved by using the one or more air cushions, is typically caused by: a) the friction between the air molecules and between the air molecules and the inner structure of the air cushions and b) the inertia effect of the air in case of an impact.

According to a further aspect of the disclosure, the suspension member is made of a resilient material. For example, the suspension member may include a rubber suspension.

The resilient material may comprise a polymer having large viscosity and elasticity and weak inter-molecular forces and a low Young's modulus. The resilient material may be an elastomer such as fluorocarbon, rubber, e.g. ethylene propylene (EPM) rubber, ethylene propylene diene (EPDM) rubber or silicone rubber. The use of elastomers secures high failure strain compared with other materials.

According to a further embodiment of the disclosure, one or more spacers are provided at an inner periphery of the suspension member.

The one or more spacers allow for arranging and fixing the one or more cushions or one or more enclosed structures in desired positions in a space between the receiver and the suspension member. The one or more spacers may be adapted to maintain shape of the one or more cushions or one or more enclosed structures. When the one or more cushions or one or more enclosed structures are air filled, the one or more spacers may be adapted to ensure that the one or more cushions or one or more enclosed structures get their original or resting shape and that the air flows back after an impact.

According to yet another aspect of the disclosure, the one or more spacers protrude from the inner periphery of the suspension member. Hereby, structures such as groove structures are adapted to receive one or more cushions or one or more enclosed structures.

According to a further aspect of the disclosure, the one or more spacers are integrated parts or detachably fixed parts of the suspension member.

Application of the one or more spacers as integrated parts of the suspension member allow for positioning the spacers in predefined positions, whereas application of the one or more spacers as detachably fixed parts of the suspension member allow for exchanging the spacers or adjusting the position of the one or more spacers.

According to another aspect of the disclosure, the one or more spacers comprise a resilient material, the one or more spacers being configured to absorb shock.

Hereby, the one or more spacers are capable of protecting the hearing aid receiver against shock.

According to a further embodiment of the disclosure, one or more through-going vents are provided in the suspension member. Hereby, air may be introduced or evacuated through the vents. In this manner, it is possible to allow the air to flow in or out in a controlled manner. The size of the vents may be designed in order to meet specific requirements such as specific flow rates in order to facilitate a desired effect.

The one or more through-going vents make it possible to circulate air. When the one or more cushions or one or more enclosed structures comprise air, air can disappear out of the one or more cushions or one or more enclosed structures (e.g. air cushions) and can flow back after an impact.

According to another aspect of the disclosure, the suspension member comprises one or more sealing members. The one or more sealing members may be provided as sealing lips.

The one or more sealing members make it possible to provide a sealing and thus controlling the air flow when applying one or more air filled cushions or one or more air filled enclosed structures. The one or more sealing members may have any suitable size and geometry.

According to a further aspect of the disclosure, the one or more cushions or one or more enclosed structures are integrated in or detachably fixed at the inside structure of the suspension member.

Hereby, a robust and reliable construction can be achieved. The position of the one or more cushions or one or more enclosed structures can hereby be controlled in order to achieve the most effective shock protection.

According to another aspect of the disclosure, the one or more cushions or one or more enclosed structures have a geometry that fits the outer geometry of the receiver. Hereby, the shock protection potential of the one or more cushions or one or more enclosed structures is optimized.

According to an even further aspect of the disclosure, the one or more cushions or one or more enclosed structures comprise:

one or more continuous structures containing air/another filler material or a series of continuous sub-structure forming the cushions.

Hereby, some cushioning will be available even if one or a few of the sub structures fail/are damaged.

According to a further aspect of the disclosure, the one or more cushions or one or more enclosed structures are positioned between adjacent spacers and/or positioned between a spacer and a vent and/or positioned between a spacer and a sound port exit.

By having such a construction, it is possible to maintain the one or more cushions or one or more enclosed structures in desired positions in an easy and reliable manner.

According to another aspect of the disclosure, the receiver assembly comprises a detachably connected receiver housing adapted to accommodate receivers of different geometry and/or size and/or mechanical dimensions.

Hereby, it is possible to apply the same receiver housing for receiving different receivers.

Instead of developing a new receiver housing for each different hearing device (which is resource demanding and time-consuming), it is possible to provide the receiver housing as a "catalogue" component that can be used in several hearing devices.

Moreover, future products can re-use a moulded receiver housing and integrate another receiver within the receiver housing if needed.

By having a receiver assembly that comprises a detachably connected receiver housing adapted to accommodate receivers of different geometry and/or size and/or mechanical dimensions, the receiver housing can be used for multiple receiver configurations and provide an optimum protection against impacts.

According to a further aspect of the disclosure, the receiver housing comprises a front portion and a rear portion, wherein the front portion and the rear portion comprises attachment structures for detachable attachment of the front portion to the rear portion. Hereby, the receiver housing can easily be assembled.

According to another aspect of the disclosure, a sound tube protrudes from the suspension member, wherein the receiver assembly comprises a casing tube inserted into the sound tube or encasing the sound tube, wherein the casing tube is made of a material that is harder than the sound tube.

Hereby, it is possible to reduce the emitted sound pressure in the hearing aid. It is further possible to reduce the vibration level produced by the hearing aid receiver.

According to a further aspect of the disclosure, the casing tube is made of a plastic material or a metal, such as aluminium. By manufacturing the sound tube in a resilient material (e.g. an elastomer), the material of the casing tube will be harder than the material of the sound tube.

According to a further aspect of the disclosure, the casing tube is an integrated part of the sound tube, wherein the casing tube is an in-moulded structure of the casing tube.

Hereby, the number of components can be reduced. Further, a correct position of the casing tube can be achieved.

According to another aspect of the disclosure, the casing tube is a separate structure arranged in the sound tube.

Hereby, it is possible to adjust the position of the casing tube relative to the sound tube e.g. for meeting specific user-related requirements.

According to an even further aspect of the disclosure, a sound hook is attached to the sound tube, wherein an acoustic damper element is arranged within the sound hook. The damper element is an acoustic damper that is adapted to reduce resonant peaks and achieve smooth and gently rising hearing aid response. Typically, such acoustic damper comprises a fine mesh inserted across a small metal cylinder or ferrule. Dampers may also be made of sintered stainless steel, plastics, lamb's wool or from plastic foam.

Hereby, the risk of the damper element detaching is eliminated by inserting the damper in the sound hook with a press fit. Furthermore, no fluids or un-wanted particles can enter the sound hook and the hearing aid receiver.

By having a damper element that is arranged in the sound hook, the damper element is prevented from being moved in the hook sound tube.

In an embodiment, the damper element may be made in a soft polymer that allows the damper element to obtain any desired geometrical form and to meet requirements regarding tolerances.

According to another aspect of the disclosure, the damper element is coated with a hydrophobic material.

According to a further aspect of the disclosure, the system includes a hearing aid according to the disclosure, wherein the system comprises an insertion tool having a flexible rod member configured to receive an acoustic damper element, wherein the insertion tool is adapted to position the acoustic damper element in a predefined position within the sound hook.

Hereby, the acoustic damper element can be positioned in a predefined position within the sound hook of a hearing aid. Accordingly, improvements in sound, for example by smoothing sound channel resonances and/or achieving a frequency response perceived as pleasant, can be achieved.

BRIEF DESCRIPTION OF DRAWINGS

The aspects of the disclosure may be best understood from the following detailed description taken in conjunction with the accompanying figures. The figures are schematic and simplified for clarity, and they just show details to improve the understanding of the claims, while other details are left out. Throughout, the same reference numerals are used for identical or corresponding parts. The individual features of each aspect may each be combined with any or all features of the other aspects. These and other aspects, features and/or technical effects will be apparent from and elucidated with reference to the illustrations described hereinafter in which:

FIG. 6A illustrates a schematic top view of an acoustic damper element according to an embodiment of the disclosure;

FIG. 6B illustrates a schematic side view of the acoustic damper element shown in FIG. 6A;

FIG. 6C illustrates a schematic side view of the acoustic damper element shown in FIG. 6A and the tool for inserting the acoustic damper element into a sound hook;

FIG. 6D illustrates a schematic side view of tool shown in FIG. 6C during insertion of an acoustic damper element into a sound hook;

FIG. 7A illustrates a schematic cross-sectional view of an air cushion according to an embodiment of the disclosure;

FIG. 7B illustrates a schematic cross-sectional view of another air cushion according to an embodiment of the disclosure;

FIG. 7C illustrates a schematic cross-sectional view of a further air cushion according to an embodiment of the disclosure;

DETAILED DESCRIPTION

Figure 1:
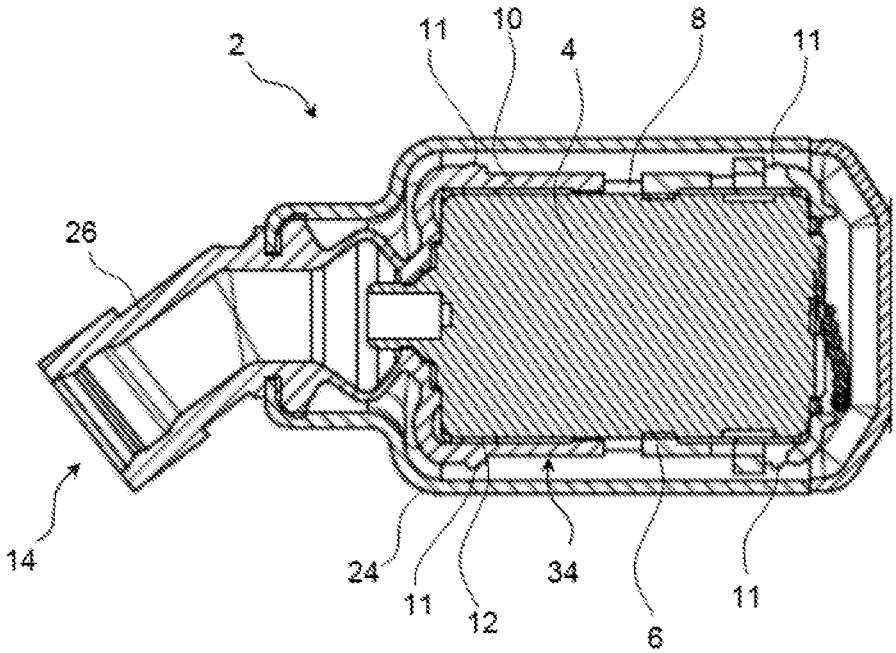
FIG. 1 illustrates a schematic cross sectional view of a receiver assembly according to an embodiment of the disclosure.

The detailed description set forth below in connection with the appended drawings is intended as a description of various configurations. The detailed description includes specific details for the purpose of providing a thorough understanding of various concepts. However, it will be apparent to those skilled in the art that these concepts may be practiced without these specific details. Several aspects of the apparatus are described by various blocks, functional units, modules, components, etc. (collectively referred to as "elements").

A hearing aid may include a hearing aid that is adapted to improve or augment the hearing capability of a user by receiving an acoustic signal from a user's surroundings, generating a corresponding audio signal, possibly modifying the audio signal and providing the possibly modified audio signal as an audible signal to at least one of the user's ears. The "hearing aid" may further refer to a device such as an earphone or a headset adapted to receive an audio signal electronically, possibly modifying the audio signal and providing the possibly modified audio signals as an audible signal to at least one of the user's ears. Such audible signals may be provided in the form of an acoustic signal radiated into the user's outer ear. The hearing aid may also include hearables that enable an input from a user such as a user voice input or input from an electronic device such as a smartphone/smartwatch, heart rate monitor, etc. or a sensor comprised in the hearing aid such as temperature sensor, and in response to the input produces an audible sound using the receiver of the receiver assembly.

The hearing aid is adapted to be worn in any known way. This may include i) arranging a unit of the hearing aid behind the ear with a tube leading air-borne acoustic signals into the ear canal or with a receiver/loudspeaker arranged close to or in the ear canal such as in a Behind-the-Ear type hearing aid, and/or ii) arranging the hearing aid entirely or partly in the pinna and/or in the ear canal of the user such as in a In-the-Ear type hearing aid or In-the-Canal/Completely-in-Canal type hearing aid.

A "hearing system" refers to a system comprising one or two hearing aids, and a "binaural hearing system" refers to a system comprising two hearing aids where the devices are adapted to cooperatively provide audible signals to both of the user's ears. The hearing system or binaural hearing system may further include auxiliary device(s) that communicate with at least one hearing aid, the auxiliary device affecting the operation of the hearing aids and/or benefitting from the functioning of the hearing aids. A wired or wireless communication link between the at least one hearing aid and the auxiliary device is established that allows for exchanging information (e.g. control and status signals, possibly audio signals) between the at least one hearing aid and the auxiliary device. Such auxiliary devices may include at least one of remote controls, remote microphones, audio gateway devices, mobile phones, public-address systems, car audio systems or music players or a combination thereof. The audio gateway is adapted to receive a multitude of audio signals such as from an entertainment device like a TV or a music player, a telephone apparatus like a mobile telephone or a computer, a PC. The audio gateway is further adapted to select and/or combine an appropriate one of the received audio signals (or combination of signals) for transmission to the at least one hearing aid. The remote control is adapted to control functionality and operation of the at least one hearing aids. The function of the remote control may be implemented in a SmartPhone or other electronic device, the SmartPhone/electronic device possibly running an application that controls functionality of the at least one hearing aid.

In general, a hearing aid includes i) an input unit such as a microphone for receiving an acoustic signal from a user's surroundings and providing a corresponding input audio signal, and/or ii) a receiving unit for electronically receiving an input audio signal. The hearing aid further includes a signal processing unit for processing the input audio signal and an output unit such as the receiver comprised in the disclosed receiver assembly for providing an audible signal to the user in dependence on the processed audio signal.

The input unit may include multiple input microphones, e.g. for providing direction-dependent audio signal processing. Such a directional microphone system is adapted to enhance a target acoustic source among a multitude of acoustic sources in the user's environment. In one aspect, the directional system is adapted to detect (such as adaptively detect) from which direction a particular part of the microphone signal originates. This may be achieved by using conventionally known methods. The signal processing unit may include an amplifier that is adapted to apply a frequency dependent gain to the input audio signal. The signal processing unit may further be adapted to provide other relevant functionality such as compression, noise reduction, etc. The output unit may include an output transducer such as a loudspeaker/receiver.

Now referring to FIG. 1A, which illustrates a schematic cross sectional view of a receiver assembly 2 according to an embodiment of the disclosure.

The receiver assembly 2 comprises a receiver housing 24 constituting the outer periphery of the major part of the receiver assembly 2. At one end of the receiver housing 24, the receiver housing comprises a sound tube 26. The end portion edge of the receiver housing 24 has been engagingly received by groove structures provided in the sound tube 26. A sound port 14 is provided in the distal end portion of the sound tube 26. The distal end is defined as the end of the sound tube 26 away from the receiver 4.

A basically box-shaped receiver 4 is arranged in an inner housing, defining the suspension 34, positioned centrally in the receiver housing 24. The inner housing 34 and the sound tube 26 constitute a one-piece body. This may be accomplished by a moulding process. In order to protect the receiver 4 against shock, compressible air cushions 10 are provided between the receiver 4 and the inner housing 34. The air cushions 10 are configured to protect the receiver 4 against shock in case of an impact.

The receiver assembly 2 comprises a receiver 4 arranged in the inner housing (suspension) 34 that also includes a suspension member. The suspension member comprises vibration dampers 11 protruding from the outer periphery of the suspension 34. The vibration dampers are adapted to avoid or limit transfer of vibrations from the receiver 4 to other components such as microphone of the hearing aid. In other words, the protruding vibration dampers have the function to transfer as little vibration from receiver to the receiver housing 24.

Spacers 12 are provided at the inner periphery of the suspension 34. The spacers make it possible to arrange and fix the one or more cushions or one or more enclosed structures in desired positions in the space between the receiver and the suspension member. The spacers 12 allow for maintaining and regaining (when deformed) the form of the air cushions 10. The spacers 12 comprise a resilient material.

The spacers 12 together with the remaining inner structure of the suspension 34 define a groove structure adapted to receive the air cushions 10. The spacers 12 may be manufactured as integrated parts of the suspension member.

A number of through-going vents 8 are provided in the suspension 34 (and thus in the suspension member). Accordingly, air may be introduced and evacuated through the through-going vents 8. Therefore, it is possible to allow the air to flow in and out of the air cushions 12 in a controlled manner. By means of the vents 8, it is possible to circulate air: air can disappear out of the air cushions 12 and flow back after an impact.

The inner housing 34 is provided with sealing members 6 shaped as sealing lips 6 configured to sealingly control the air flow flowing into and out of the air cushions 10.

The cushions 10 are detachably fixed at the inside structure of the suspension 34. Further, the cushions 10 have a geometry that fits the outer geometry of the receiver 4. Hereby, the most effective protection of the receiver against shock can be provided.

Figure 2B:
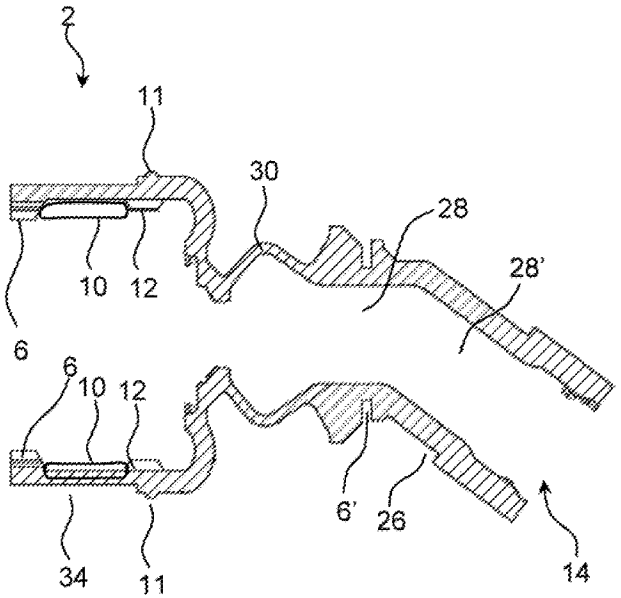
FIG. 2B illustrates a schematic cross sectional view of the front suspension shown in FIG. 2A.
Figure 2A:
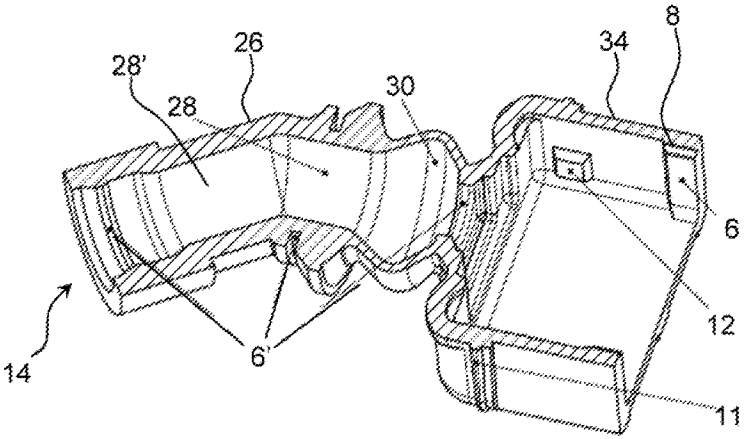
FIG. 2A illustrates a schematic perspective cross sectional view of a front suspension according to an embodiment of the disclosure.

FIG. 2A illustrates a schematic perspective cross sectional view of the central portions of a front suspension according to an embodiment of the disclosure (the receiver housing 24 shown in FIG. 1 has been removed). FIG. 2B illustrates a schematic cross sectional view of the front suspension shown in FIG. 2A.

The front suspension comprises a basically box-shaped front portion on an suspension 34 and a sound tube 26 made as a one-piece body, wherein the sound tube 26 extends as an extension of the basically box-shaped front portion of the suspension 34.

A sound port 14 (an opening) is provided in the distal end of the sound tube 26. The sound tube 26 comprises a sound channel member comprising a first sound channel 28 and a second sound channel 28' extending in extension of the first sound channel 28. The sound tube 26 is provided with sealing members 6' and an arched structure 30 in the proximal portion of the sound tube 26.

The front portion of the inner housing 34 is provided with sealing members 6 and spacers 12 protruding inwardly from the inner periphery of the suspension 34. Vibration dampers 11 are provided at the outside structure of the front portion of the suspension 34. The vibration dampers 11 are configured to limit transfer of vibrations from receiver and hereby provide a reduction in feedback.

In FIG. 2A, no air cushions are shown; however, in FIG. 2B air cushions 10, the spacers 12 and the sealing lips 6 are illustrated.

From the illustrated FIG. 2A, it can be seen that the receiver assembly 2 comprises the suspension 34 having a front portion.

The receiver assembly 2 comprises the suspension 34 with a sound tube 26, a housing 24 for receiving the suspension 34. A lid member may also be included for closing an open end (opposite to the end comprising the sound tube) of the housing 24.

Figure 3C:
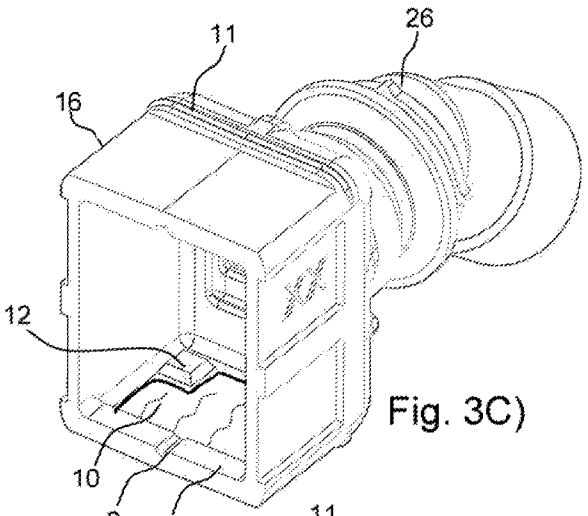
FIG. 3C illustrates a schematic perspective view of a front portion of the suspension according to an embodiment of the disclosure.
Figure 3D:
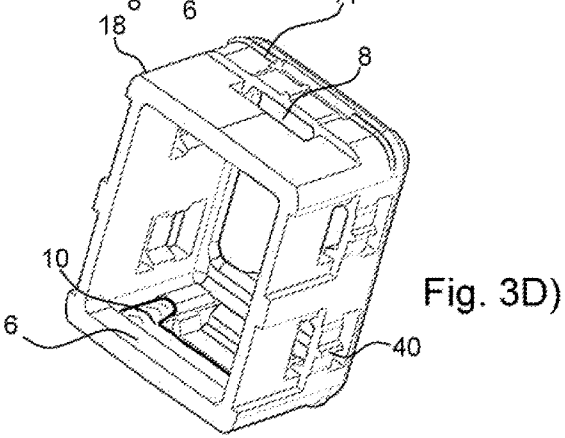
FIG. 3D illustrates a schematic perspective view of the rear portion of the suspension according to an embodiment of the disclosure.
Figure 3A:
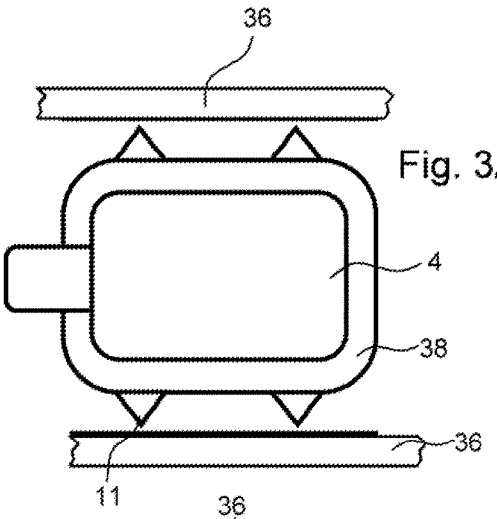
FIG. 3A illustrates a schematic view of a prior art receiver assembly.
Figure 3B:
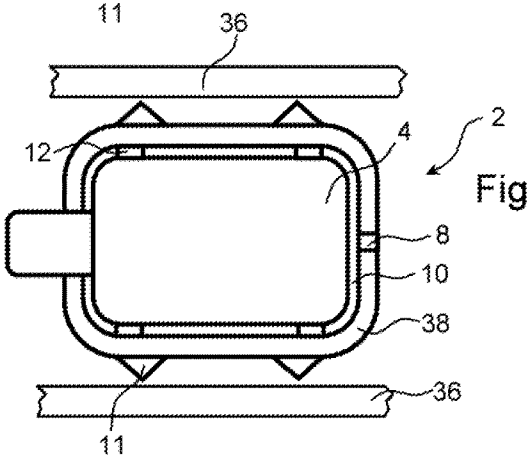
FIG. 3B illustrates a schematic view of a receiver assembly according to an embodiment of the disclosure.

FIG. 3A illustrates a schematic view of a prior art receiver assembly, whereas FIG. 3B illustrates a schematic view of a receiver assembly 2 according to an embodiment of the disclosure. The receiver assembly 2 comprises a receiver centrally arranged in a suspension member 38. A housing 36 encloses the suspension member 38. Vibration dampers 11 configured to dampen vibration from the receiver 4 before the vibration reaches the housing 36. A plurality of spacers 12 are provided between the receiver 4 and the suspension member 38. Further, an air cushion 10 is provided between the receiver 4 and the suspension member 38.

The spacers are applied to maintain the positon of the air cushion 10. A vent 8 being in fluid communication with the air cushion 10 is provided in the suspension member 38. The vent 8 is configured to introduce air into and evacuate air from the cushion 10. Accordingly, it is possible to allow the air to flow in and out in a controlled manner. The cushion 10 protects the receiver 4 against shock.

FIG. 3C illustrates a schematic perspective view of a front portion 16 of the suspension according to an embodiment of the disclosure. The front portion 16 of the suspension comprises a suspension member and a sound tube 26 provided as a one-piece body. The suspension member is provided with vibration dampers 11 protruding from the outside periphery of the suspension. The suspension member is provided with sealing lips extending along a portion of the inner periphery of the suspension member. A vent 8 is provided in the sealing member 8. Further, an air cushion 10 is attached to the inside structure of the suspension.

FIG. 3D illustrates a schematic perspective view of the rear portion 18 of suspension according to an embodiment of the disclosure. The rear portion 18 of the suspension comprises a basically box-shaped suspension. The suspension is provided with vibration dampers 11 protruding from the outside periphery of the suspension member and with sealing lips extending along a portion of the inner periphery of the suspension member. A vibration damper 40 is provided at the outer periphery of the suspension. Moreover, the suspension is provided with an elongated vent 8 for venting the receiver when arranged in the suspension. An air cushion 10 is attached to the inside structure of the suspension.

Figures 4A, 4B, 4C:
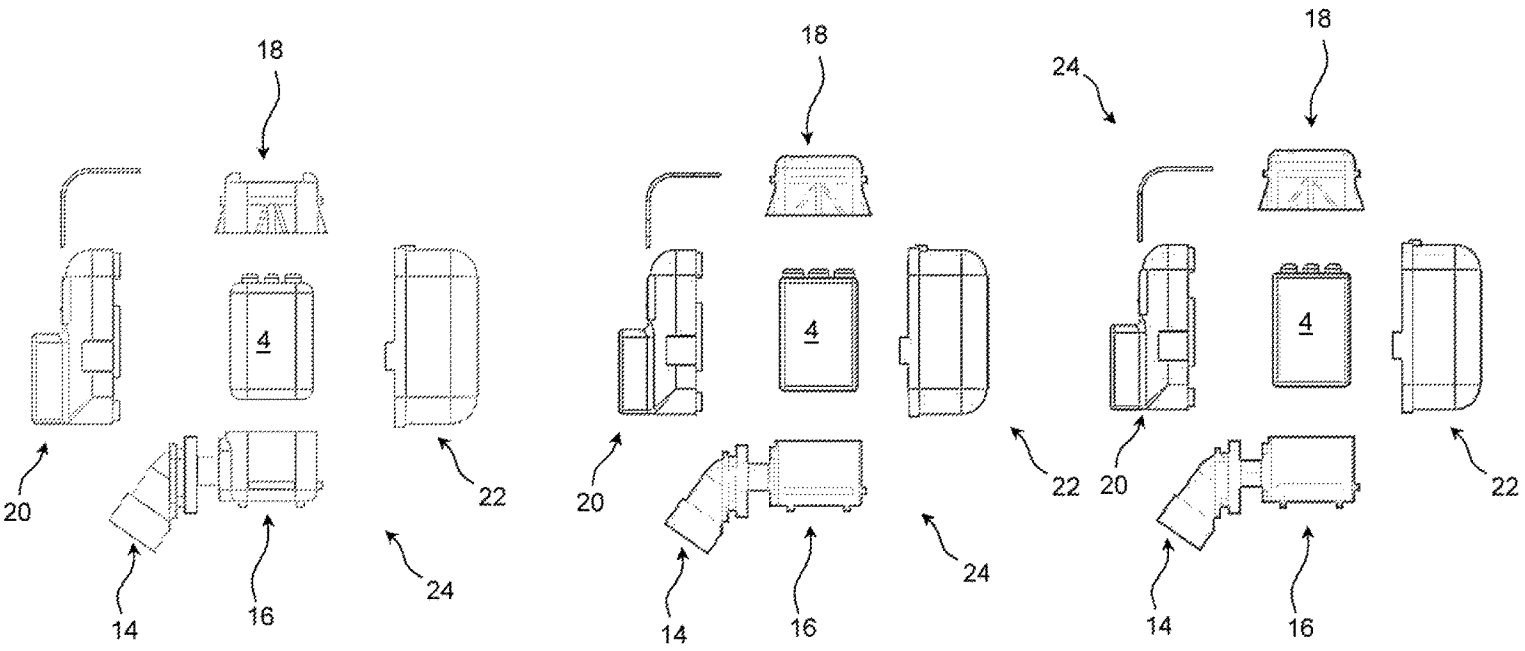
FIG. 4A illustrates a schematic exploded view of a receiver assembly according to an embodiment of the disclosure.
FIG. 4B illustrates a schematic exploded view of another receiver assembly according to an embodiment of the disclosure.
FIG. 4C illustrates a schematic exploded view of a further receiver assembly according to an embodiment of the disclosure.

FIG. 4A illustrates a schematic exploded view of a receiver housing 24 according to an embodiment of the disclosure. The receiver housing 24 comprises a front portion 20, a rear portion 22 and a first receiver 4 configured to be received by a suspension having a front end 16 (with a sound tube provided with a sound port 14) and a back end 18. The structures of the receiver housing 24 are constructed to accommodate receivers 4 of different geometry and/or size and/or mechanical dimensions.

The front portion 20 and the rear portion 22 comprises mechanical attachment structures (not shown in detail) for detachable attachment of the front portion 20 to the rear portion 22.

FIG. 4B illustrates a schematic exploded view of another receiver housing 24 according to an embodiment of the disclosure. The receiver housing 24 comprises a front portion 20, a rear portion 22 and a first receiver 4 configured to be received by the suspension having a front end 16 (having a sound tube equipped with a sound port 14) and a back end 18. These structures correspond to the ones shown in FIG. 4A; however the receiver 4 differs from the one shown in FIG. 4A. Accordingly, the receiver housing 24 is configured to receive receivers 4 of different types and sizes.

FIG. 4C illustrates a schematic exploded view of a further receiver housing 24 according to an embodiment of the disclosure. The receiver housing 24 comprises a front portion 20, a rear portion 22 and a first receiver 4 configured to be received by suspension having a front end 16 (provided with a sound tube having a sound port 14) and a back end 18. These structures correspond to the ones shown in FIG. 4A and in FIG. 4B; however the receiver 4 differs from the one shown in FIG. 4A and in FIG. 4B.

By using a receiver housing 24 as the one illustrated in FIG. 4A, FIG. 4B and FIG. 4C, it is possible to accommodate receivers of different geometry and/or size and/or mechanical dimensions. The receiver housing 24 is constructed in a manner such that the receiver housing 24 has the same external dimensions when the front portion 20 and rear portion 22 are attached to each other. Hereby, the front portion 20 and the rear portion 22 can attach irrespective of the geometry of the receiver 4. When applying the receiver housing 24 to house receivers 4 of different geometry, suspension may be changed in geometry to house receivers of different geometry. Having common dimensions for the receiver housing 24 for different receivers ensures that the slot for accommodating the receiver assembly within hearing aid casing can be standardized for different receiver types.

Figure 5C:
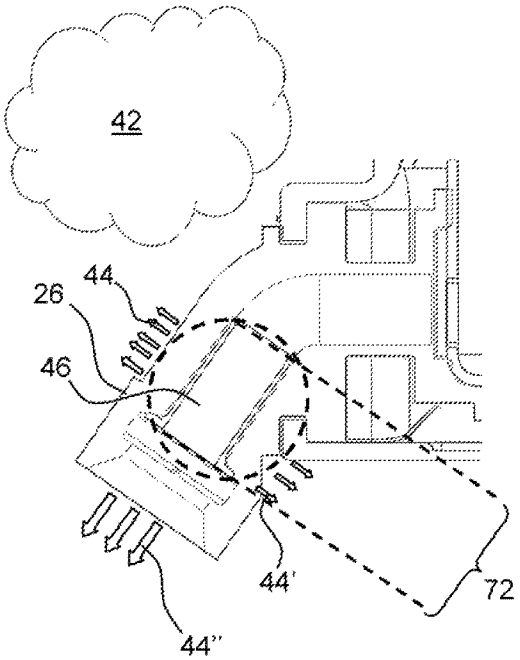
FIG. 5C illustrates a schematic view of the receiver assembly shown in FIG. 5A, wherein the casing tube shown in FIG. 5B has been inserted into the sound tube.
Figure 5B:
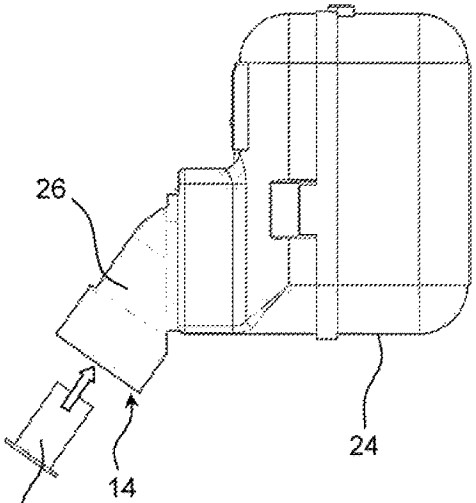
FIG. 5B illustrates a schematic view of a casing tube being inserted into the sound tube of the receiver assembly that is shown in FIG. 5A.
Figure 5A:
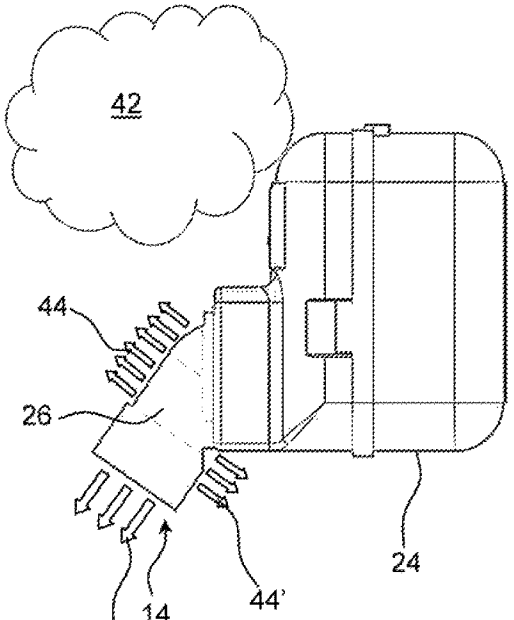
FIG. 5A illustrates a schematic view of a receiver assembly according to an embodiment of the disclosure.

FIG. 5A illustrates a schematic view of a receiver housing 24 according to an embodiment of the disclosure. The receiver housing 24 houses an inner housing, defining the suspension, having a sound tube 26 extending as the visible distal portion of the inner housing. Due to the activity of the receiver (not shown) housed in the receiver housing 24, the indicated sound pressures 44, 44', 44" (indicated with arrows) are generated. The length and size of the arrows are indicative of the magnitude of the sound pressure and it can be seen that the largest sound pressure 44" is present at the sound port 14, whereas lower sound pressures 44, 44' are present along the outer periphery of the sound tube 26. The latter, sound pressures 44, 44' are uncontrolled and unwanted sound pressure emitted from the receiver.

The microphone 42 of the hearing aid in which the receiver housing 24 is used, is illustrated as a schematic cloud structure.

FIG. 5B illustrates a schematic view of a casing tube 46 being inserted into the sound tube 26 of the receiver housing 24 that is shown in FIG. 5A. The casing tube 46 is made in a material (aluminium or plastic) that is harder than the material of the sound tube 26 (e.g. a rubber material).

The hard casing tube 46 may alternatively be an in-moulded portion of the sound tube 26 instead of being a separate structure as shown in FIG. 5B.

The sound tube 26 will typically be made in rubber that expands upon being exposed to sound pressure. Furthermore, the sound tube 26 will emit unwanted sound pressure towards a microphone positioned in proximity to the sound tube 26.

FIG. 5C illustrates a schematic view of the receiver housing shown in FIG. 5A, wherein the casing tube 46 shown in FIG. 5B has been inserted into the sound tube 26. Comparing to FIG. 5A, it can be seen that the magnitude (indicated by the length of the arrows) of the unwanted sound pressures 44, 44' along the outer periphery of the sound tube 26 is reduced, while the magnitude of the (indicated by the length of the arrows) sound pressure 44" present at the sound port 14 is maintained. Accordingly, by inserting the casing tube 46 into the sound tube 26, wherein the casing tube 46 is made in a material that is harder than the sound tube 26, it is possible to reduce the unwanted sound pressures 44, 44" reaching the microphone, thus reducing the feedback issue.

As it can be seen in FIG. 5A, the casing tube 46 may be inserted into a receiving portion 72 in the distal portion of the sound tube 26. The sound tube 26 may be referred to as a receiver outlet tube.

FIG. 6A illustrates a schematic top view of an acoustic damper element 50 according to an embodiment of the disclosure. FIG. 6B illustrates a schematic side view of the acoustic damper element shown 50 in FIG. 6A.

The acoustic damper element 50 has a basically cylindrical structure. The acoustic damper element 50 is provided with a flat end member having a gridded structure and a centrally arranged plate member 52. The acoustic damper element 50 may include a specified number of holes and a predefined cross section.

The acoustic damper element 50 can be hydrophobically coated for better reliability performance against moisture. The acoustic damper element 50 is configured to be positioned in the ear hook in order to improve the sound, for example by smoothing sound channel resonances and/or achieving a frequency response perceived as pleasant.

FIG. 6C illustrates a schematic side view of the acoustic damper element 50 shown in FIG. 6A and the tool 54 for inserting the acoustic damper element 50 into a sound hook 58. The tool 54 comprises a shank and a flexible rod member 56 attached thereto. As it can be seen in FIG. 6C, the acoustic damper element 50 can be attached to the distal portion of the flexible rod member 56.

FIG. 6D illustrates a schematic side view of tool 54 shown in FIG. 6C during insertion of an acoustic damper element 50 into a sound hook 58.

It can be seen that the flexible rod member has been inserted into the sound channel of the sound hook 58. Moreover, the acoustic damper element 50 (indicated with a dotted line) is positioned in the sound channel of the sound hook 58.

It is preferred that the tool 54 comprises an activation member adapted to release the acoustic damper element 50 from its attachment to the distal portion of the flexible rod member 56. Such an activation member may be provided as a mechanical structure comprising a user-activated knob (e.g. a press button or a turnable button) provided at the shank of the tool 54. Thus, the tool 54 may include a means configured to hold the damper element 50 at a distal end of the rod member 56 as shown in FIG. 6C and to release the damper when the damper is positioned at a desired location within the sound hook 58.

The desired location is defined by length of the rod member 56 as shown in FIG. 6D. Additionally or alternatively, the desired location is defined by graduated markings along length of the rod member 56, the graduated marking corresponding to different insertion depths within the sound hook 58.

FIG. 7A illustrates a schematic cross-sectional view of an air cushion 10 according to an embodiment of the disclosure. The air cushion 10 comprises a plurality of sub-structures 64 filled with filler material 62. Each sub-structure 64 is a continuous structure containing air or another filler material 62. Thus, the air cushion 10 comprises a series of continuous sub-structures 64 forming the cushion 10. The sub-structures 64 have a basically rectangular outer structure. Although not shown, the cushion 10 is provided with one or more vents for introducing air into the cushion 10 and for evacuating air from the cushion 10.

By means of the vent(s) (not shown), the air pressure inside the air cushion 10 can be maintained at a level corresponding to the atmospheric pressure.

By having an air cushion 10 comprising a plurality of sub-structures 64, some sub-structures 64 will be available even if one or a few of the sub structures 64 fail/are damaged.

FIG. 7B illustrates a schematic cross-sectional view of another air cushion 10 according to an embodiment of the disclosure. The air cushion 10 comprises a base structure 66 dividing the air cushion 10 into an upper portion 68 and a lower portion 68'. The upper portion 68 comprises a plurality of sub-structures 64 filled with air 62 and/or another filler material. Each sub-structure 64 is attached to the base structure 66 and its adjacent sub-structure 64.

The lower portion 68' comprises a plurality of sub-structures 64' filled with air 62 and/or another filler material.

Each sub-structure 64' is attached to the base structure 66 and its adjacent sub-structure 64'.

The sub-structures 64, 64' constitute an air cushion 10 provided with vent(s) (not shown) for providing circulation of air into the air cushion 10 and out of the air cushion 10.

FIG. 7C illustrates a schematic cross-sectional view of a further air cushion 10 according to an embodiment of the disclosure. The air cushion 10 comprises a base structure 66 provided with a plurality of vent members 70 configured to let air into the air cushion 10 and evacuate air out of the air cushion 10.

The air cushion 10 comprises a plurality of separated air filled sub-structures 64 attached to the base structure 66. The sub-structures 64 are in fluid communication with a hollow structure in the base structure 66 and with the vent members 70. Accordingly, the vent members 70 can be used to introduce air into the sub-structures 64 and to evacuate air out of the sub-structures 64.

Figures 7, 7D, 7E:
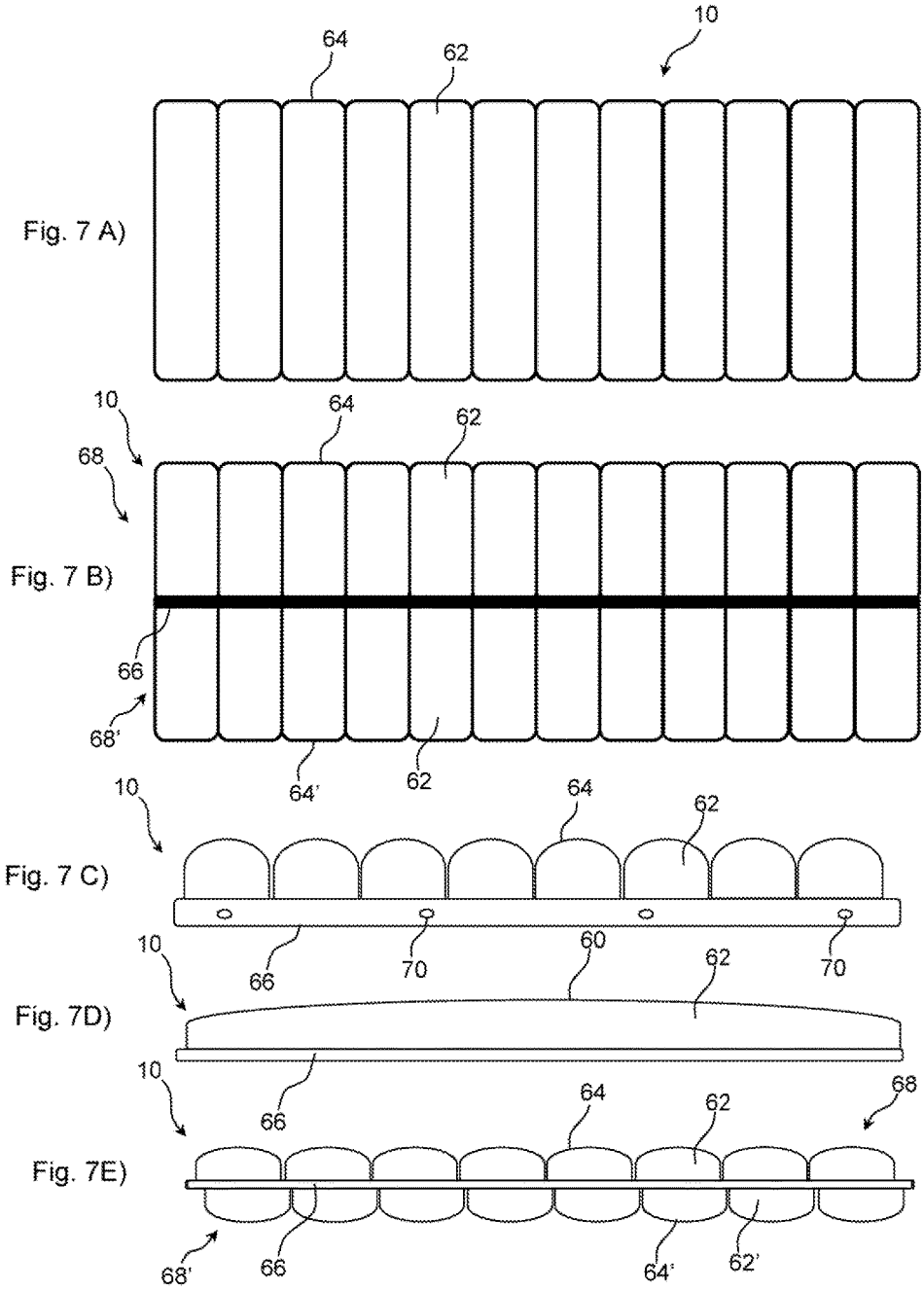
FIG. 7D illustrates a schematic cross-sectional view of an even further air cushion according to an embodiment of the disclosure and FIG. 7E illustrates a schematic cross-sectional view of another air cushion according to an embodiment of the disclosure.

FIG. 7D illustrates a schematic cross-sectional view of an even further air cushion 10 according to an embodiment of the disclosure. The air cushion 10 comprises one enclosed structure 60 that is attached to a base structure 66. The structure 60 is filled with air 62.

FIG. 7E illustrates a schematic cross-sectional view of another air cushion 10 according to an embodiment of the disclosure. The air cushion 10 comprises a base structure dividing the air cushion 10 into an upper portion 68 and a lower portion 68'. The upper portion 68 comprises a plurality of air-filled sub-structures 64. Each sub-structure 64 is attached to the base structure 66 and its adjacent sub-structure 64.

The lower portion 68' comprises a plurality of sub-structures 64' filled with air 62. The sub-structures 64, 64' constitute an air cushion 10 provided with vent(s) (not shown) for introducing air 62 into the sub-structures 64, 64' and to evacuate air 62 out of the sub-structures 64, 64'.

It is intended that the structural features of the devices described above, either in the detailed description and/or in the claims, may be combined with steps of the method, when appropriately substituted by a corresponding process.

It should be appreciated that reference throughout this specification to "one embodiment" or "an embodiment" or "an aspect" or features included as "may" means that a particular feature, structure or characteristic described in connection with the embodiment is included in at least one embodiment of the disclosure. Furthermore, the particular features, structures or characteristics may be combined as suitable in one or more embodiments of the disclosure. The previous description is provided to enable any person skilled in the art to practice the various aspects described herein. Various modifications to these aspects will be readily apparent to those skilled in the art, and the generic principles defined herein may be applied to other aspects.

The claims are not intended to be limited to the aspects shown herein, but is to be accorded the full scope consistent with the language of the claims, wherein reference to an element in the singular is not intended to mean "one and only one" unless specifically so stated, but rather "one or more." Unless specifically stated otherwise, the term "some" refers to one or more.

Accordingly, the scope should be judged in terms of the claims that follow.

LIST OF REFERENCE NUMERALS

2 Receiver assembly
4 Receiver
6, 6' Sealing member
8 Vent
10 Air cushion
11 Vibration dampers
12 Spacer
14 Sound port
16 Front end of suspension
18 Rear end of suspension
20 Front portion of receiver housing
22 Rear portion of receiver housing
24, 36 Receiver housing
26 Sound tube
28, 28' Sound channel
30 Arced structure
34, 38 Suspension/Suspension member
40 Vibration damper
42 Microphone
44, 44', 44" Sound pressure
46 Casing tube
48 Structure
50 Acoustic damper element
52 Plate member
54 Tool
56 Flexible rod member
58 Sound hook
60 Structure
62, 62' Filler material
64, 64' Sub-structure
66 Base structure
68 Upper portion
68' Lower portion
70 Vent member
72 Receiving portion

The invention claimed is:

1. A hearing aid comprising a receiver assembly comprising a suspension member, the suspension member comprising a plurality of spacers provided at an inner periphery of the suspension member;

wherein the plurality of spacers is positioned to form grooves between adjacent spaces and wherein one or more cushions or enclosed structures are provided in the formed grooves.

2. A hearing aid according to claim 1, wherein the plurality of spacers provided at the inner periphery of the suspension member are configured to maintain or regain, when deformed, the shape of the one or more cushions or enclosed structures.

3. A hearing aid according to claim 1, wherein the plurality of spacers are integrated parts or detachably fixed parts of the suspension member.

4. A hearing aid according to claim 1, wherein the plurality of spacers comprises a resilient material, the plurality of spacers being configured to absorb shock.

5. A hearing aid according to claim 1, wherein the suspension member comprises one or more vents.

6. A hearing aid according to claim 1, wherein the suspension member comprises one or more sealing members configured to control air flowing into and out of the one or more or enclosed structures.

7. A hearing aid according to claim 1, wherein the one or more cushions or one or more enclosed structures are integrated in or detachably fixed at the inside structure of the suspension member.

8. A hearing aid according to claim 1, wherein each of the one or more cushions or enclosed structures is formed by one or more continuous structures containing air or another filler material or a series of continuous sub-structures forming a cushion.

9. A hearing aid according to claim 1, wherein the receiver assembly comprises a housing having detachably connected housing components adapted to define the housing in an attached configuration and adapted to accommodate receivers of different geometry and/or size and/or mechanical dimensions.

10. A hearing aid according to claim 1, wherein the receiver assembly comprises a housing having a front portion and a rear portion, wherein the front portion and the rear portion comprises attachment structures for detachable attachment of the front portion to the rear portion.

* * * * *